US005200286A

United States Patent [19]

Yashiki et al.

[11] Patent Number: 5,200,286

[45] Date of Patent: Apr. 6, 1993

[54] ELECTROPHOTOGRAPHIC PHOTORECEPTOR

[75] Inventors: Yuichi Yashiki; Kazuya Hongo; Seiji Ashiya, all of Kanagawa, Japan

[73] Assignee: Fuji Xerox Co., Ltd., Tokyo, Japan

[21] Appl. No.: 652,254

[22] Filed: Feb. 6, 1991

Related U.S. Application Data

[63] Continuation of Ser. No. 201,172, Jun. 2, 1988, abandoned.

[30] Foreign Application Priority Data

Jun. 4, 1987 [JP] Japan ..... 62-138922

[51] Int. Cl.[5] ..... G03G 15/02; G03G 15/04; G03G 15/08

[52] U.S. Cl. ..... 430/58; 430/64; 430/93; 430/900

[58] Field of Search ..... 430/58, 64, 93, 900

[56] References Cited

U.S. PATENT DOCUMENTS

| | | | |
|---|---|---|---|
| T870,006 | 1/1970 | Contois | 430/83 X |
| 3,512,966 | 5/1970 | Shattuck et al. | 430/83 X |
| 3,879,201 | 4/1975 | Williams et al. | 430/83 X |
| 3,917,482 | 11/1975 | Fida et al. | 430/80 X |
| 3,961,954 | 6/1976 | Pfister et al. | 430/83 X |
| 3,997,342 | 12/1976 | Bailey | 430/75 X |
| 4,033,769 | 7/1977 | Williams et al. | 430/83 X |
| 4,218,529 | 8/1980 | Pu et al. | 430/78 |
| 4,264,694 | 4/1981 | Pu et al. | 430/58 |
| 4,302,521 | 11/1981 | Takei et al. | 430/58 X |
| 4,396,696 | 8/1983 | Nagasaka et al. | 430/77 |
| 4,820,620 | 4/1989 | Carolla | 430/84 |

FOREIGN PATENT DOCUMENTS

| | | | |
|---|---|---|---|
| 55-157748 | 12/1980 | Japan | 430/58 |
| 2145835A | 4/1985 | United Kingdom | 430/58 |

*Primary Examiner*—Marion E. McCamish
*Assistant Examiner*—S. Crossan
*Attorney, Agent, or Firm*—Finnegan, Henderson, Farabow, Garrett and Dunner

[57] ABSTRACT

An electrophotographic photoreceptor is disclosed, comprising a substrate having thereon at least an electric charge generating layer and an electric charge transporting layer, characterized in that the electric charge generating layer is formed from a coating solution which is prepared by dispersing an electric charge generating material and an acid in a binder resin solution. Useful acids are inorganic acids, including hydrochloric acid, sulfuric acid, hydrobromic acid and phosphoric acid, and organic acids, including formic acid, acetic acid, propionic acid, butyric acid, lactic acid, benzoic acid and sulfonic acid. This material has an increased sensitivity and thus can be effectively used in copying machines.

8 Claims, 1 Drawing Sheet

ELECTROPHOTOGRAPHIC PHOTORECEPTOR

This application is a continuation of application Ser. No. 07/201,172, filed Jun. 2, 1988 now abandoned.

FIELD OF THE INVENTION

The present invention relates to a laminate-type electrophotographic photoreceptor having increased sensitivity.

BACKGROUND OF THE INVENTION

Electrophotographic photoreceptor are known which include a material using an inorganic photoconductive substance and a material using an organic photoconductive substance. Such photoreceptor using an organic photoconductive substance have been increasingly used in recent years because of the advantages that they cause less pollution of the environment, their productivity is high and production costs are low.

Such organic photoconductive substances for generating an electric charge on absorbing visible light have a disadvantage that the electric charge retention is poor. On the other hand, a substance having a good electric charge retention and excellent film-forming properties generally has a disadvantage that it does not always exhibit photoconductivity due to visible light.

In order to overcome the above disadvantages, a laminate-type electrophotographic photoreceptor comprising an electric charge generating layer which generates an electric charge on absorbing visible light and an electric charge transporting layer which transports the electric charge have been developed. In this laminated structure, an electric charge generating material and an electric charge transporting material can be chosen independently, and they can be chosen from a wide variety of materials. Representative examples of electric charge generating materials include polycyclic quinone pigments, perillene pigments, indigo pigments, bisbenzoimidazole pigments, quinacridone pigments, phthalocyanine pigments, mono-azo pigments, di-azo pigments, tri-azo pigments, poly-azo pigments and the like. Representative examples of electric charge transporting materials include amine compounds, hydrazone compounds, pyrazoline compounds, oxazole compounds, oxadiazole compounds, stibene compounds, carbazole compounds and the like.

In preparing an electrophotographic photoreceptor using the above materials, it is necessary to select a material which is satisfactory in all characteristics, e.g. electrophotographic characteristics such as sensitivity, electric receiving potential, electric potential retention properties, electric potential stability, residual electric potential, spectral characteristics and the like, and use characteristics such as strength, durability, anti-pollution properties and the like.

Of the above characteristics, sensitivity is the most important for an electrophtographic photoreceptor, and thus it is still desired to increase the sensitivity. The sensitivity is mainly determined by a combination of an electric charge generating material and an electric charge transporting material. However, the sensitivity also varies with preparation conditions of the electric charge generating layer and the electric charge transporting layer, the method of preparation of components, and so forth.

The sensitivity can be increased to a certain extent by increasing the thickness of the electric charge generating layer and/or the electric charge transporting layer. Increasing the thickness of the layers, however, is limited because of resulting changes in physical properties other than the sensitivity and because of limitations of production techniques and so forth. To increase the sensitivity, it is also effective to increase the proportion of the electric charge generating material in the electric charge generating layer. However, this is also limited by changes of physical properties other than the sensitivity and limitations of production techniques. It has, therefore, been more desirable to increase the sensitivity with specified types of an electric charge generating material and an electric charge transporting material.

SUMMARY OF THE INVENTION

An object of the present invention is to provide an electrophotographic photoreceptor which is increased in sensitivity alone without changing the type of material, the proportion of components, the thickness of each layer and so forth.

The inventors have found the at the sensitivity can be increased by dispersing an electric charge generating material and an acid in a binder resin solution.

The present invention relates to a laminate-type electrophotographic photoreceptor comprising a substrate having thereon at least an electric charge generating layer and an electric charge transporting layer, wherein the electric charge generating layer is formed from a coating solution prepared by adding an electric charge generating material in combination with an acid in a binder resin solution.

DETAILED DESCRIPTION OF THE INVENTION

Figure 1:
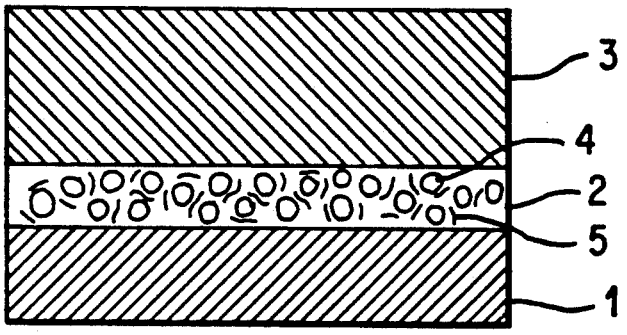
FIG. 1 is a schematic cross-sectional view of an electrophotographic photoreceptor of the present invention.
Figure 2:
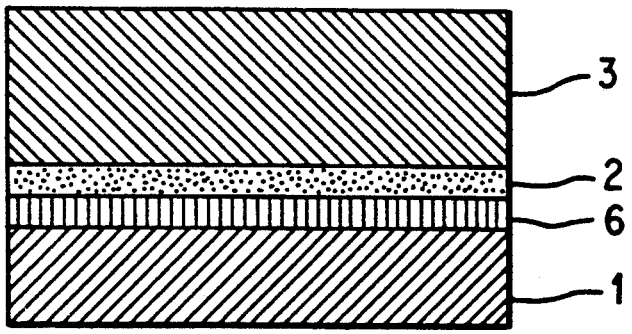
FIG. 2 is a schematic cross-sectional view of another electrophotographic photoreceptor of the present invention.

FIG. 1 is a schematic view illustrating a cross section of an electrophotographic photoreceptor of the present invention, in which an electric charge generating layer is shown on an enlarged scale. Referring to FIG. 1, an electric charge generating layer 2 is provided on a substrate 1 and an electric charge transporting layer 3 is provided on the electric charge generating layer 2. The electric charge generating layer 2 contains an electric charge generating material 4 and an acid 5. FIG. 2 is a schematic view of another embodiment of the present invention, in which a barrier layer 6 is sandwiched between the substrate 1 and the electric charge generating layer 2.

The substrate to be used in the electrophotographic photoreceptor of the present invention can be selected from one of those commonly used in conventional electrophotographic photoreceptor. Examples of the substrate used in the present invention include a metal drum or metal sheet such as aluminum, copper, iron, zinc, nickel; a paper or plastic film coated or impregnated with an electric conductivity imparting agent; a glass drum, glass sheet or glass plate treated with aluminum copper or aurum; a paper or plastic film deposited with metals such as mercury, platinum, palladium, titanium, nickel-chromium, stainless steel, copper-indium, etc., and electrically conductive compounds such as $In_2O_2$, $SnO_2$, etc; a paper or plastic film laminated with metal foils; and carbon black.

The electric charge generating layer is formed on the substrate by coating the substrate with a dispersion containing an electric charge generating material in a powder form in a binder resin solution. The present invention is characterized in that a dispersion containing both the electric charge generating material and an acid is used.

The sensitivity can be increased by applying a treatment wherein the acid is added at the time of dispersing the electric charge generating material, as described hereinbelow.

Representative examples of acids which can be used include inorganic acids such as hydrochloric acid, sulfuric acid, nitric acid, hydrobromic acid, phosphoric acid and the like; or organic acids such as formic acid, acetic acid, propionic acid, butyric acid, lactic acid, benzoic acid, sulfonic acid and the like, and their halogen-substituted derivative, nitro group-substituted derivatives, alkyl-substituted derivatives, and the like. Of these, organic acids compatible with organic solvents, particularly mono-, di- or tri- - fluoroacetic acid are preferred because of their high sensitivity increasing effect.

As the electric charge generating material, known pigments effective for this purpose can be used. For example, polycyclic quinone pigments, perillene pigments, indigo pigments, bisbenzo-imidazole pigments, quinacridone pigments, phthalocyanine pigments, mono-azo pigments, di-azo pigments, tri-azo pigments and poly-azo pigments, polynuclear quinone-based pigments, perillene pigments, phthalocyanine pigments, monoazo pigments diazo pigments, squarylium pigments, and the like can be sued. Among these, the polynuclear quinone-based pigments and the perillene pigments are referred in the present invention.

The electric charge generating material can be dispersed by known techniques such as by the use of a ball mill, a roll mill, a sand mill, an attritor and the like.

Representative examples of binder resins include, for example, polycarbonate, polystyrene, polyester, polyvinyl butyral, methacrylic acid ester polymers or copolymers, vinyl acetate polymers or copolymers, cellulose esters or ethers, polybutadiene, polyurethane, polyvinyl butyral, an epoxy resin and the like. Among these, polyester, polyvinyl butyral, and vinyl acetate polymers or copolymers are preferred.

The acid may be added at the point at which the electric charge generating material is dispersed in a solution of the above binder resin. However, in order to more efficiently obtain the action of the acid, it is preferred that the electric charge generating material be subjected to acid treatment by dispersing it into the acid solution and then adding the binder resin solution to disperse the electric charge generating material and acid solution into the binder resin solution.

The amount of the acid added preferably is generally from about 0.1 to 1 mol % and preferably from 0.3 to 1.5 mol %, of the electric charge generating material. If the amount of the acid added is to small, the sensitivity increasing effect is low. On the other hand, if the amount of acid is too large, physical properties other than sensitivity are affected; for example, charged electric potential is reduced and repeating stability is decreased. In the case of water-containing acids such as hydrochloric acid, nitric acid and the like, it is necessary to calculate the amount of acid used on the basis of the moles of acid less th contained water. Although water may be mixed in the dispersion, it does not cause any problems because the amount of water mixed is very small as compared with the total amount of the dispersion.

The sensitivity increasing effect obtained is greater when the electric charge generating material is dispersed in a solvent, the acid is added and dispersed therein, and the resulting dispersion is added to the binder resin solution and dispersed in the resin, as compared to when the electric charge generating material is mixed with the resin solution previously containing the acid and the dispersion formed.

The electric charge transporting layer comprises the aforementioned electric charge transporting material and a resin having film forming properties. As mentioned hereinabove, representative examples of electric charge transporting materials, include amine compounds, hydrazone compounds, pyrazoline compounds, oxazole compounds, oxadiazole compounds, stilbene compounds, carbozole compounds and the like. Representative examples of resins include well-known binder resins such as polycarbonate, polyacrylate, polyester, polystyrene, a styrene-acrylonitrile copolymer, polysulfone, polymethacrylate, a styrene-methylate copolymer and the like. Among these, polycarbonate, polyacrylate and polyester are preferred. The ratio of the electric charge transporting material to the resin preferably is 5/1 to 1/5 and, more preferably, 3/1 to 1/3. If the amount of the electric charge transporting material is too large, the mechanical strength of the electric charge transporting layer deceases. On the other hand, if it is too small, the sensitivity decreases. The thickness of the electric charge generating layer is preferably about 0.05 to 5 μm and more preferably about 0.1 to 3 μm and the thickness of the electric charge transporting layer is preferably about 5 to 50 μm and more preferably about 10 to 30 μm.

As shown in FIG. 2, a barrier layer 6 may be formed between the electric charge generating layer 2 and the substrate 1. The barrier layer is effective in inhibiting the injection into the electric charge generating layer of unnecessary electric charges from the substrate, and can increase charging properties of the light-sensitive layer (i.e., a laminate composed of the electric charge generating layer and the electric charge transporting layer). Furthermore, the barrier layer increases the adhesion between the light-sensitive layer (i.e., the electric charge generating layer or the electric charge transporting layer) and the substrate. Representative examples of the barrier layer material include a material such as polyvinyl alcohol, polyvinyl pyrrolidone, polyvinyl pyridine, cellulose ethers, cellulose esters, polyamide, polyurethane, casein, gelating, polyglutamic acid, startch acetate, amine starch, polyacrylic acid salts, polyacrylamide and the like. Among theses, polyamide, cellulose ethers and cellulose esters are preferred. The resistance of the material is preferably about $10^5$to $10^{14}$ Ω.cm and more preferably about $10^8$ to $10^{13}$ Ω.cm. The thickness of the barrier layer is preferably about 0.05 to 2 μm and more preferably about 0.05 to 1.5 μm.

The exact reason why sensitivity is increased by adding an acid to the electric charge generating layer is not certain. It is believed, however, that the acid changes the surface properties of the electric charge generating material and forms an electric charge transporting complex with the aforementioned electric charge transporting material (all of which are electron donating compounds). The acid readily collects around the electric charge generating material. In the interface between the electric charge generating layer and the electric charge transporting layer, an electric charge migrating complex is formed as a result of contact between the acid and the electric charge transporting material, and a low resistance portion is formed where the electric resistance is decreased. The acid is originally of low resistance as compared with the binder resin. It is considered, therefore, that when the electric charge generating layer is irradiated with light, the injection of photoelectric charge from the electric charge generating material directly to the electric charge transporting layer is more difficult than the injection of photo-electric charge from the electric charge generating material through the low resistance portion of the acid and electric charge migrating complex, and thus the electric charge flows more easily, leading to an increase in injection properties and an increase in sensitivity.

In the electrophotographic photoreceptor of the present invention, the electric charge generating layer is formed by dispersing the electric charge generating layer is formed by dispersing the electric charge generating material in the acid. Therefore, the electrophotographic photoreceptor of the present invention has an increased sensitivity as compared with those not containing the acid.

The electrophotographic photoreceptor of the present invention can be used effectively in electrophotgraphic copying machines, and further, can be applied to various printers, microfilm readers, electrophotographic print-making systems and the like, utilizing xerography techniques.

The present invention is described in greater detail with reference to the following examples.

EXAMPLE 1 AND COMPARATIVE EXAMPLE 1

One part (by weight, hereinafter all parts are by weight) of a polyvinyl butyral resin (trade name: BMl, produced by Sedisui Kagaku Co., Ltd.) was dissolved in 19 parts of cyclohexanone. The resulting solution was mixed 8 parts of dibromoanthanthron pigment (C.I. Pigment Red 168) and 0.02 part of trifluoroacetic acid. In this case, the amount of the acid was 1 mol % of the pigment.

Then, dispersion of the resulting mixture was conducted in a sand with 1 mm glass beads (particle size: 1 mm) as the dispersant. To the dispersion was further added cyclohexanone to prepare a coating solution having a solid concentration of about 10 wt %.

A solution of a nylon 8 resin (trade name: lacquera-mide produced by Dai Nippon Ink Co., Ltd) in a mixed solvent of methanol/butanol was coated on a 84 mm (diameter)×310 mm (length) aluminum pipe to form a 0.8 μm thick barrier layer. On this barrier layer, the above coating solution was coated by the use of a ring coating machine and dried by heating at 100° C. for 10 minutes to form a 0.8 μm thick electric charge generating layer.

5 parts of N,N'-diphenyl-N,N'-bis(3-methylphenyl)[1,1'-biphenyl]-4,4'-diamine as an electric charge transporting material and 6 parts of a polycarbonate Z resin were dissolved in 40 parts of monochlorobenzene. The solution thus obtained was coated by the dip coating method and dried at 100° C. for 1 hour to form a 20 μm thick electric charge transporting layer.

For comparison, an electrophotographic photoreceptor was prepared in the same manner as above except that in dispersing the pigment, trifluoroacetic acid was not added (Comparative Example 1).

The electrophotographic photoreceptor was charged to −800 V and then irradiated with white light to cause light damping. At his time, an exposure amount E (erg/cm$^2$) and a damping amount of electric potential V were measured, and the sensitivity dV/dE was determined. The above charging and irradiation with white light was repeated 20 times, and then the sensitivity was measured in the same manner as above.

The results are shown in the table below.

TABLE

| Electrophotographic Photoreceptor | Sensitivity (V · cm$^2$/ergs) | |
|---|---|---|
| | First Time | 20th Time |
| Example 1 | 89 | 90 |
| Comparative Example 1 | 82 | 81 |

As is apparent from the above results, the electrophotographic photoreceptor of Example 1 in which the acid was added was higher in sensitivity.

EXAMPLE 2

8 parts of the same pigment as used in Example 1 was mixed with 0.02 part of trifluoroacetic acid and 12 parts of cyclohexanone, and the resulting solution was thoroughly stirred by application of supersonic waves for 30 minutes. A solution of 1 part of the same polyvinyl butyral resin as used in Example 1 and 7 parts of cyclohexanone was added, and the resulting mixture was subjected to sand mill dispersion. To the dispersion was further added cyclohexanone to prepared a coating solution having a solids concentration of about 10 wt %.

Using the coating solution as prepared above, an electrophotographic photoreceptor was prepared in the same manner as in Example 1. The sensitivity at the first time was 90 V.cm$^2$/ergs, and at the 20th time also 90 V.cm$^2$/ergs.

EXAMPLE 3

In Example 1, in place of the trifluoroacetic acid, 0.036 part of 35% hydrochloric acid was used. In this case, the amount of the acid (hydrogen chloride) was 2 mol % of the pigment. An electrophotographic photoreceptor was prepared in the same manner as in Example 1 except that the trifluoroacetic acid was replaced by the hydrochloric acid as described above. The sensitivity at the first time was 89 V.cm$^2$/ergs, and at the 20th time, 88 V.cm$^2$/ergs. In a case where the hydrochloric acid was used in an amount of 0.018 part (the amount of the acid was 1 mol % of the pigment), the sensitivity was 85 V.cm$^2$/ergs at the first time and 85 V.cm$^2$/ergs at the 20th time.

Thus, in the electrophotographic photoreceptor of the present invention, the electric charge generating layer is formed by dispersing the electric charge generating material in the acid. Therefore, the electrophotographic photoreceptor of the present invention has an increased sensitivity as compared with those not containing the acid.

While the invention has been described in detail and with reference to specific embodiments thereof, it will be apparent to one skilled in the art that various changes and modifications can be made therein without departing from the spirit and scope thereof.

What is claimed is:

1. A function separated electrophotographic photoreceptor comprising a substrate having thereon at least an electric charge generating layer and an electric charge transporting layer, wherein the electric charge generating layer is formed from a coating solution prepared by dispersing an electric charge generating material in powder form in an acid and then adding the resulting dispersion to an electrically inert binder resin solution, said acid being selected from the group consisting of: inorganic acids including hydrochloric acid, sulfuric acid, nitric acid, hydrobromic acid and phosphoric acid; and organic acids including formic acid, acetic acid, propionic acid, butyric acid, lactic acid, benzoic acid, sulfonic acid, and their halogen-substituted derivatives, nitro group-substituted derivatives, and alkyl-substituted derivatives; said acid being present in an amount of about 0.1 to 2 mol percent of said electric charge generating material, wherein said electric charge generating layer has a thickness of from about 0.05 to 5 μm and said electric charge transporting layer has a thickness of from about 5 to 50 μm, wherein the acid within the electric charge generating layer contacts the electric charge transporting layer at an interface between the electric charge generating layer and the electric charge transporting layer to form an electric charge migration resulting in a contact sensitization at the interface.

2. The electrophotographic photoreceptor as in claim 1, wherein said acid is an organic acid.

3. The electrophotographic photoreceptor as in claim 1, wherein said acid is an inorganic acid.

4. The electrophotographic photoreceptor as in claim 1, further comprising a barrier layer between said substrate and said electric charge generating layer, said barrier layer being effective to inhibit the injection of electric charges from said substrate.

5. The electrophotographic photoreceptor as in claim 1, wherein the acid is at least one organic acid selected from the group consisting of mono-fluoroacetic acid, di-fluoroacetic acid, and tri-fluoroacetic acid.

6. The electrophotographic photoreceptor as claimed in claim 1, wherein said electrically inert binder resin is at least one compound selected from the group consisting of polycarbonate, polystyrene, polyester, polyvinyl butyral, methacrylic acid ester polymers or copolymers, vinyl acetate polymers or copolymers, cellulose esters or ethers, polybutadiene, polyurethane, polyvinyl butyral and an epoxy resin.

7. The electrophotographic photoreceptor as claimed in claim 1, wherein said electrically inert binder resin is at least one compound selected from the group consisting of polyester, polyvinyl butyral, and vinyl acetate polymers or copolymers.

8. The electrophotographic photoreceptor as in claim 1, wherein said electric charge generating material is a pigment selected from the group consisting of polycyclic quinone pigments, perillene pigments, indigo pigments, bisbenzo-imidazole pigments, quinacridone pigments, phthalocyanine pigments, mono-azo pigments, di-azo pigments, tri-azo pigments, poly-azo pigments, polynuclear quinone-based pigments, perillene pigments, phthalocyanine pigments, monazo pigments, diazo pigments, and squarylium pigments.

* * * * *